US008151506B2

(12) United States Patent
Anders

(10) Patent No.: US 8,151,506 B2
(45) Date of Patent: Apr. 10, 2012

(54) MUZZLE LOADER UNLOADING TOOL

(76) Inventor: Michael Anders, Oconomowoc, WI (US)

( * ) Notice: Subject to any disclaimer, the term of this patent is extended or adjusted under 35 U.S.C. 154(b) by 231 days.

(21) Appl. No.: 12/204,334

(22) Filed: Sep. 4, 2008

(65) Prior Publication Data

US 2010/0281746 A1 Nov. 11, 2010

(51) Int. Cl.
*F41C 9/08* (2006.01)
*F41C 27/00* (2006.01)

(52) U.S. Cl. ..... 42/90

(58) Field of Classification Search ..... 42/51, 90; 89/1.3

See application file for complete search history.

(56) References Cited

U.S. PATENT DOCUMENTS 4,817,321 A 4/1989 Clement
4,888,901 A * 12/1989 French et al. ..... 42/51
5,109,623 A 5/1992 French
5,133,143 A 7/1992 Knight
6,216,380 B1 4/2001 McGarity, Jr. et al.
6,219,951 B1 * 4/2001 Cate ..... 42/51
6,311,421 B1 11/2001 Knight
6,532,692 B2 3/2003 Cate
7,073,283 B2 7/2006 Watley
7,316,092 B2 1/2008 DeLeeuw
7,526,888 B1 * 5/2009 Joyce ..... 42/51
7,621,064 B2 * 11/2009 Laney et al. ..... 42/51
7,793,455 B1 * 9/2010 Laney ..... 42/95
2001/0013191 A1 8/2001 Cate
2007/0163162 A1 * 7/2007 Laney et al. ..... 42/51

* cited by examiner

*Primary Examiner* — Bret Hayes
(74) *Attorney, Agent, or Firm* — Boyle Fredrickson, S.C.

(57) ABSTRACT

The unloading tool of the present invention includes a tube having a breech end and a distal end. The unloading tool may have threads at the breech end of the tube for releasably engaging a breech of a firearm so as to facilitate the removal and reloading of powder with respect to the breech. The present invention further encompasses a method for unloading powder from the breech of firearm including the steps of securing a breech end of a tubular unloading tool to a breech of the firearm and tilting the firearm to remove powder from the breech and into the unloading tool.

12 Claims, 4 Drawing Sheets

MUZZLE LOADER UNLOADING TOOL

BACKGROUND OF THE INVENTION

1. Field of the Invention

The present invention relates in general to the field of unloading tools for use with muzzle loader firearms. More particularly, the present invention relates to an unloading tool that facilitates removal of powder from a breech of a muzzle loader firearm and that can store the powder after it has been removed.

2. Discussion of the Related Art

Muzzle loading firearms are well known in the art. Generally speaking, a user will load the projectile and powder directly into the breech of the firearm, seal the breech with a breech plug, and then pull the trigger to fire the gun.

On occasion, the firearm is loaded but is not fired, e.g., at the end of the hunting day. In the interests of safety, the powder and projectile should be removed from the breech. In order to do so, the user typically removes the breech plug and then empties the powder either into the garbage or some other storage container. This operation can be messy and wasteful, particularly in the event that the powder is simply discarded.

What is needed therefore is an unloading tool that facilitates the unloading of the powder from the breech of a muzzle loading firearm. There is further need for an unloading tool that not only funnels unused powder into a storage container, thus reducing the amount that is wasted due to unintentional spillage, but one that may be used to store the powder.

SUMMARY AND OBJECTS OF THE INVENTION

By way of summary, the present invention is directed to an unloading tool for removing powder from the breech of a muzzle loading firearm. A primary object of the invention is to provide a device that enables the user to remove the powder for storage in the unloading tool itself or in another receptacle. Another object of the invention is to provide an apparatus that has one or more of the characteristics discussed above but which is relatively simple to manufacture and assemble using a minimum of equipment.

In accordance with a first aspect of the invention, these objects are achieved by providing an unloading tool that includes a tube having a breech end and a distal end. There are threads at the breech end for releasably engaging a breech of a firearm. The distal end may have an opening for receiving a plug, which gives the user the option of either storing powder in the unloading tool or using the unloading tool to transfer powder to a desired receptacle.

In accordance with a second aspect of the invention, an unloading tool includes a cylindrical tube having a breech end and a distal end. There is a first inner diameter near the breech end and a second inner diameter near the distal end. The second inner diameter is smaller than the first inner diameter.

In accordance with a third aspect of the invention, an unloading tool includes a cylindrical tube of about 6 inches in length having two open ends including a breech end and a distal end. The unloading tool further includes a plug that is received by the breech end, a first inner diameter near the breech end, and a second inner diameter near the distal end. The first inner diameter is larger than the second inner diameter.

In accordance with a fourth aspect of the invention, a method for unloading powder from the breech of a muzzle loading firearm includes the steps of securing a breech end of a tubular unloading tool to a breech of the firearm and tilting the firearm to remove powder from the breech and into the unloading tool. The method may include the further steps of storing the powder in the unloading tool, reloading the stored powder into the breech of the firearm, and transferring the powder to a desired receptacle.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figures 1, 2:
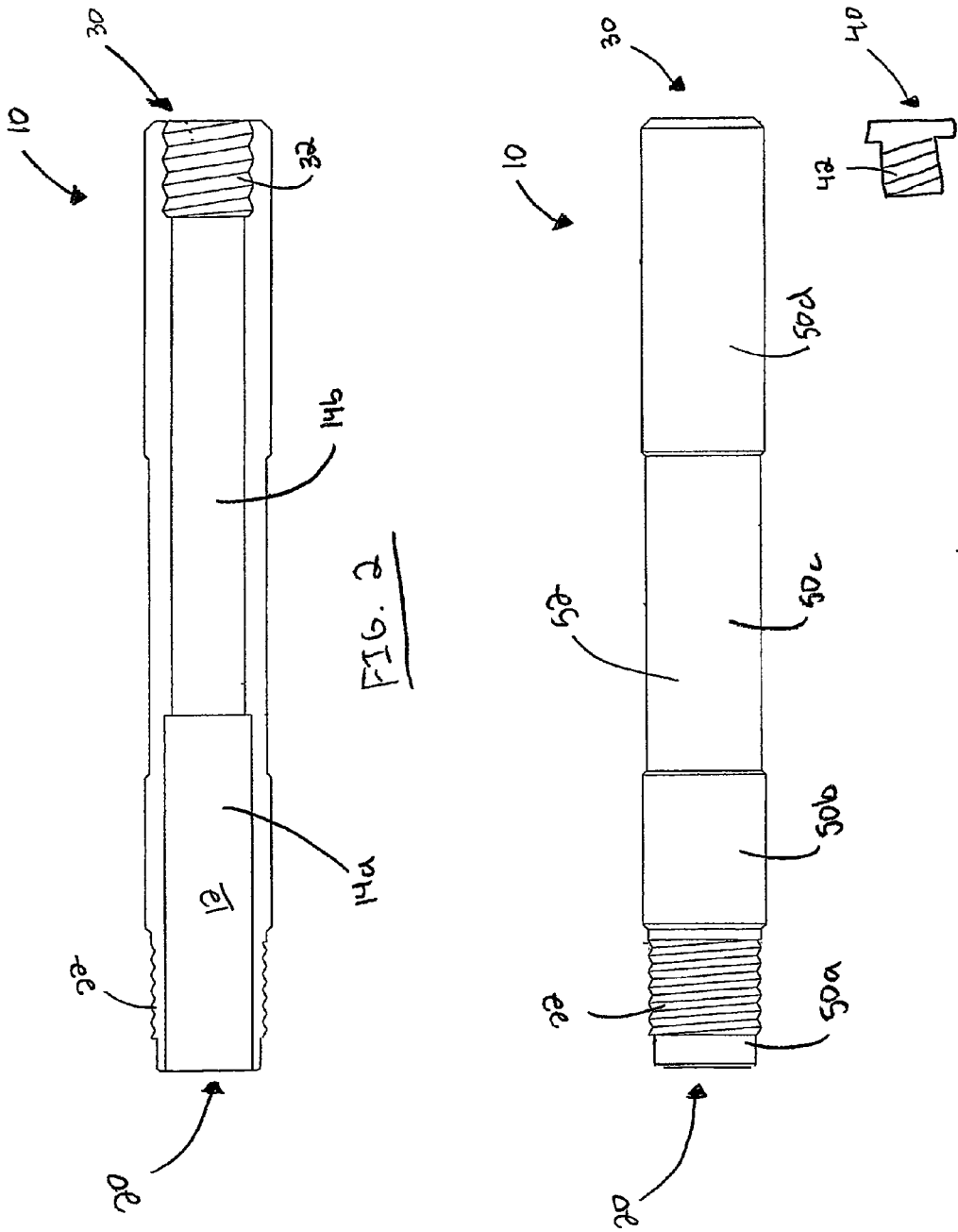
FIG. 1 illustrates a side view of one embodiment of the unloading tool of the present invention.
FIG. 2 illustrates a cross-sectional view of the embodiment of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

A preferred embodiment of the muzzle loader unloading tool 10 is shown in FIGS. 1 and 2. Generally speaking, the unloading tool 10 is intended to be used with muzzle loading firearms. See, e.g., FIG. 3. The typical operation of muzzle loading firearms is generally understood by those of skill in the art, and therefore a detailed discussion is not necessary here. By way of summary, a user loads the breech of a muzzle loading firearm with powder and a projectile. The user then seals the breech with a breech plug before firing the projectile from the firearm. In instances where the breech is loaded but not fired, the unloading tool of the instant invention may be used to facilitate removal of the powder from the breech.

As shown in the preferred embodiment of FIGS. 1 and 2, the unloading tool 10 is preferably tubular in shape. Still more preferably, the tool 10 is a hollow cylinder defining a chamber 12. The unloading tool 10 is preferably symmetrical about a longitudinal axis a of the unloading tool 10.

The unloading tool 10 has at least one open end that is a breech end 20. The breech end 20 is releasably attachable to the breech of a muzzle loading firearm. Thus, powder contained in the breech may be emptied through the breech end 20 and into the chamber 12 of the unloading tool 10.

Figure 3:
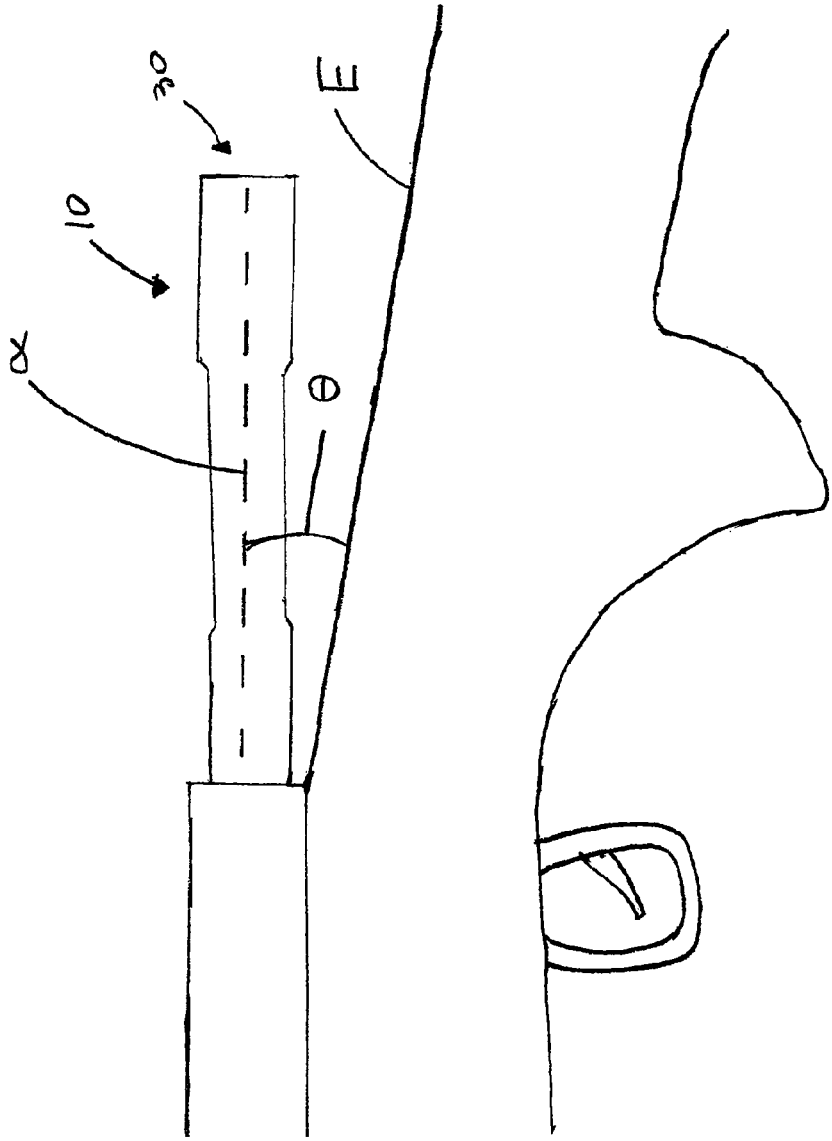
FIG. 3 shows the unloading tool in place on a muzzle loading firearm.

As shown in FIG. 3, the longitudinal axis a of the unloading tool 10 forms an angle θ with an edge E of the butt of the firearm. Preferably, the angle θ is between about 0° and about 60°, and still more preferably the angle θ is between about 5° and about 15°. This range is desirable in that it allows for easy attachment and detachment of the unloading tool and it facilitates loading and unloading of the powder. Specifically, it provides spacing between the unloading tool 10 and the edge E, which prevents edge E from interfering with the previously described activities. It should be noted that edge E may not be a straight edge. In such instances the angle θ may be measured between the longitudinal axis a of the unloading tool and a hypothetical straight line (not shown) generally following edge E.

In any event, whether edge E is straight or not, there is preferably a gap between edge E and the distal end 30 of the unloading tool 10 so as to allow for easier attachment and detachment of the unloading tool 10. In the preferred embodiment, the gap G is preferably between about ⅛ inch and about 4 inches. Clearly, the gap G may not be constant if the edge E is angled away from the unloading tool 10. It is desirable to have the gap increase nearer the distal end 30 of the unloading tool 10 because this is the end of the unloading tool 10 that is likely to be gripped by the user when attaching and removing the unloading tool 10 from the breech.

As is well known in the art, the breech of a muzzle loading firearm is typically threaded in order to receive a breech plug, e.g., the gun is loaded and then the breech plug is secured to close the breech before firing. After firing, the breech plug is unscrewed so that the breech may be reloaded.

Therefore, in the preferred embodiment of FIGS. 1 and 2, the breech end 20 has external threading 22 that corresponds with internal threading in the breech. Such a configuration enables a user to releasably secure the unloading tool 10 to the breech, e.g., the unloading tool 10 may be screwed onto the breech to unload the powder and then unscrewed after the powder has been unloaded. Any suitable attachment means may be used for releasably securing the unloading tool 10 to the breech, but given the industry standard of internally-threaded breeches, external threading 22 on the breech end 20 is preferred.

Additionally, breeches of muzzle loading firearms may have different diameters. In view of this, the dimensions of the threads 22 at the breech end 10 of the unloading tool of the present invention may be customized so as to correspond with a desired one of the pre-existing breech diameters.

In the preferred embodiment, the distal end 30 opposite the breech end is open. Thus, the unloading tool 10 serves as a guide for removing powder from the breech of a firearm. For example, the powder may be emptied through the breech end 20 (which acts like a funnel) and into a desired receptacle, e.g., a storage container.

The preferred embodiment of the unloading tool 10 further includes a plug 40 that is inserted into the distal end 30. Accordingly, the powder may be stored in the unloading tool 10 itself rather than emptying the powder directly from the breech into an alternate storage container.

The plug 40 may be made of any suitable material, but preferably it is made from nylon. The plug 40 preferably has external threads 42 that correspond with internal threads 32 in the distal end 30 of the unloading tool 10. Thus, the plug 40 may be screwed into the distal end 30 to close of the distal end 30 and store the powder in the chamber 12 of the unloading tool 10. When the user is ready to reload the firearm, the user screws the breech end 20 onto the breech of the firearm and loads the powder into the breech. In an alternative embodiment, the distal end 30 may be closed.

The unloading tool 10 may further include a cap (not shown) for sealing the breech end 20 after the powder has been unloaded into the chamber 12. The cap may include threading that corresponds with threads 22 on the breech end 20, thus allowing the cap to be releasably secured to the breech end 20. The user may empty the powder from the breech into the unloading tool 10, screw on the cap to store the powder in the unloading tool 10, and unscrew the cap to reload the powder into the breech of the firearm.

As shown in the preferred embodiment of FIG. 1, the tube has two internal sections 14*a* and 14*b*, each having a different diameter. The first internal section 14*a*, which is nearest the breech end 20, preferably has a larger diameter than the second internal section 14*b*, which is nearest the distal end 30. Preferably the diameter of first internal section 14*a* is about 120% larger than the diameter of second internal section 14*b*. Such a configuration helps to funnel powder out of the breech and through the chamber 12.

The first internal section 14*a* of the tube preferably has a length of about 2¼ inches. The second internal section 14*b* preferably has a length of about 3¾ inches. However, the lengths of these internal sections 14*a* and 14*b* may vary as desired.

Additionally, the distal end 30 may be knurled to enhance a user's grip on the unloading tool 10 to provide for easier attachment and removal of the unloading tool 10 with respect to the breech of a firearm.

The preferred embodiment of the unloading tool 10 also has an external diameter, which preferably varies along the length of the tube. Thus, the unloading tool has a first external section 50*a* having a first external diameter, a second external section 50*b* having a second external diameter, a third external section 50*c* having a third external diameter and a fourth external section 50*d* having a fourth external diameter. The fourth external section 50*d*, which is nearest the distal end 30 of the tube, is preferably of sufficient size so as to fit comfortably within the hand of a user and provide adequate torque for attaching and detaching, e.g., screwing and unscrewing, the unloading tool 10 to and from the breech of a muzzle loading firearm.

In the preferred embodiment, the external diameters of the first external section 50*a* and the third external section 50*c* are about the same, and the external diameters of the second external section 50*b* and the fourth external section 50*d* are about the same. Preferably, the external diameters of the second external section 50*b* and fourth external section 50*d* are between about 5% and about 10% larger than the diameters of the first external section 50*a* and third external section 50*d*, and more preferably they are about 7% larger.

Most preferably, the external diameter of the first external section 50*a* is about ⅜ inch, the external diameter of the second external section 50*b* is about ¾ inch, the external diameter of the third external section 50*c* is about 7/10 inch, and the external diameter of the fourth external section 50*d* is about ¾ inch.

Additionally, in the preferred embodiment the length of the first external section 50*a* is about ⅞ inch, the length of the second external section 50*b* is about 1 inch, the length of the third external section 50*c* is about 2 inches, and the length of the fourth external section is about 1⅛ inches.

As shown in FIG. 1, the threads 22 are preferably positioned on the first external section 50*a*. The preferable thread size of threads 22 is 11/16-20, and the length of the threaded section is preferably about ⅝ inch.

Figure 6:
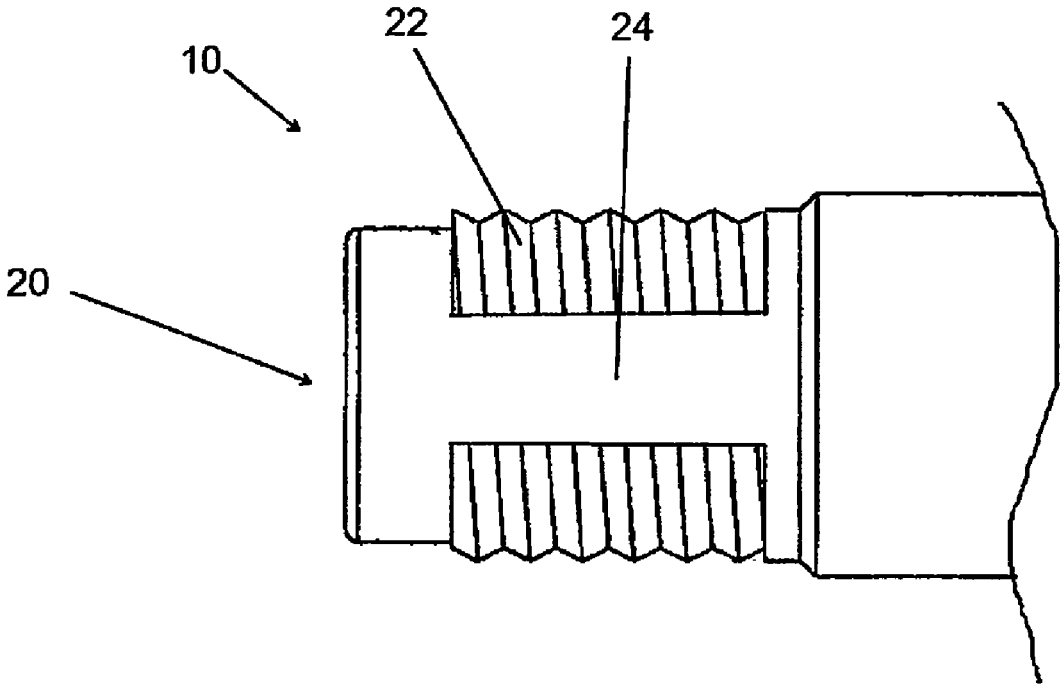
FIG. 6 shows a partial side view of another embodiment of the unloading tool of the present invention.

FIG. 6 shows the breech end 20 of an alternative embodiment of the unloading tool 10. Specifically, the threads 22 are interrupted by a flat 24, which preferably has a smooth surface. The flat 24 corresponds to a similar flat (not shown) in the corresponding threading in the breech of a firearm. Thus, when the flat 24 is properly aligned with the flat in the breech, the unloading tool 10 may be pulled from the breech without the need to unscrew the unloading tool along the entire length of the threads 22. The unloading tool 10 may have additional flats 24 to further facilitate attachment and removal of the unloading tool 10 to the breech.

Figure 4:
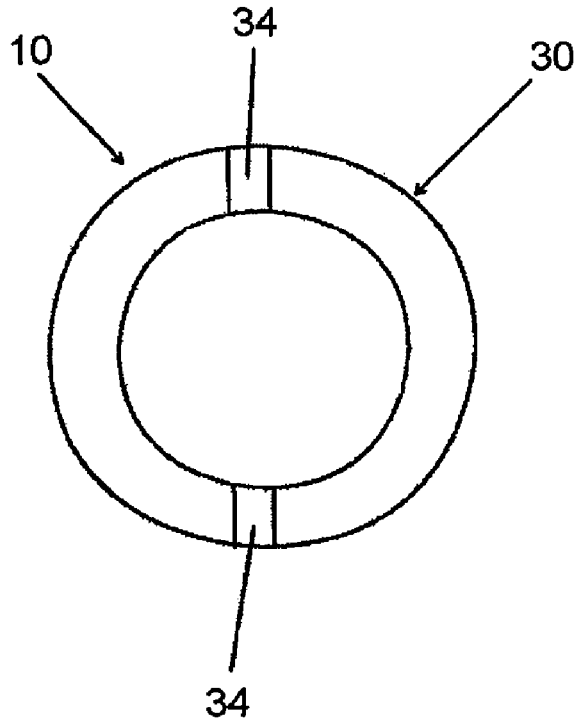
FIG. 4 shows an end view of an embodiment of the unloading tool of the present invention having a slot at the distal end.
Figure 5:
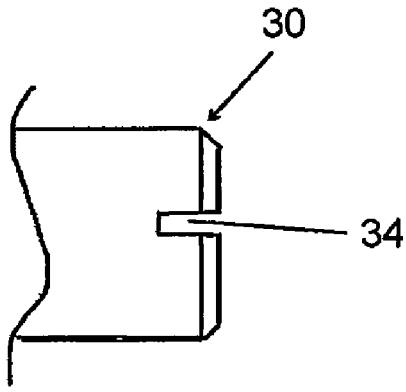
FIG. 5 shows a partial side view of the embodiment of FIG. 4.

Furthermore, the distal end 30 may be configured with a slot 34 to receive the head of a screwdriver, e.g., a Phillips head or a flat head screwdriver. See FIGS. 4 and 5. Thus, a user can use a screwdriver to more easily attach and detach the unloading tool 10 to and from the breech.

The unloading tool 10 is preferably made from aluminum. As is known in the art, the breech of a muzzle loading firearm is typically made from steel. The use of aluminum to form the unloading tool 10 will prevent unintentional and undesirable sparks (which could ignite the powder) when attaching or detaching the unloading tool from the breech.

Additionally, the unloading tool 10 may further include an O-ring at the breech end 20 of the unloading tool 10. Preferably the O-ring is made from rubber, which may help to prevent static electricity from generating sparks and potentially igniting the powder.

The external surface 52 of the unloading tool may have an image, e.g., a company name or logo. The image may be placed on the external surface using any suitable means. For example, the image may be a sticker, it may be printed on the surface 52, or it may be laser etched into the surface 52.

The unloading tool 10 is preferably of sufficient length so that when attached to the breech of a firearm, the distal end 30 of the loading tool extends beyond a site that may be attached to the firearm. Thus, the site will not interfere with or impede the unloading of powder through the unloading tool 10 and into a storage container. Additionally, damage to the site may be prevented by having an unloading tool 10 of such a length. Preferably, the unloading tool 10 is at least about 6 inches in length.

In another aspect of the invention, a method for unloading powder from a muzzle loading firearm includes the steps of securing a tubular unloading tool to a breech of the firearm and tilting the firearm to remove powder from the breech and into the unloading tool. Further steps may include securing a plug in a distal end of the unloading tool, storing the powder in the unloading tool, and/or transferring the powder through the unloading tool and into a receptacle.

If the powder is stored in the unloading tube, the method may further include the step of reloading the firearm with the powder by securing the breech end of the unloading tool to the breech of the firearm and tilting the firearm so that the powder is transferred into the breech.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. The unloading tool and method of the present invention may be used in conjunction with any now-existing or any future designs for muzzle loading firearms.

In addition, the individual components need not be fabricated from the disclosed materials, but could be fabricated from virtually any suitable materials.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

The invention claimed is:

1. An unloading tool comprising:

a tube having a breech end and a distal end of the tube, the length of the tube being sufficient to contain a charge associated with propelling a projectile from a firearm and being un-perforated along the length, the tube configured to replace a breech plug of the firearm;

threads at the breech end for releasably engaging a breech of a firearm when the breech plug associated with discharging the firearm is removed from the breech of the firearm;

an opening at the distal end for receiving a threaded plug; and internal threads at the distal end for receiving the threads of the plug.

2. The unloading tool of claim 1, wherein the tube is cylindrical and has varying outer diameters along the length of the tube.

3. The unloading tool of claim 2, further comprising:

a first external section having an outer diameter that is about the same as the outer diameter of a third external section; and a second external section having an outer diameter that is about the same as the outer diameter of a fourth external section.

4. The unloading tool of claim 3, wherein the outer diameters of the first and third external sections are both larger than the outer diameters of the second and fourth external sections.

5. The unloading tool of claim 1, further comprising two internal sections, each having a different internal diameter.

6. The unloading tool of claim 5, wherein the internal diameter of a first internal section nearest the breech end is larger than the internal diameter of a second internal section nearest the distal end.

7. The unloading tool of claim 6, wherein the internal diameter of the first internal section nearest the breech end is 120% percent larger than the internal diameter of the second internal section nearest the distal end.

8. The unloading tool of claim 6, wherein the first internal section is about 2¼ inches in length and the second internal section is about 3¾ inches in length.

9. The unloading tool of claim 1, wherein when the unloading tool is attached to the breech of a firearm, the distal end of the unloading tool is positioned rearwardly of a rear end of a site attached to the firearm.

10. The unloading tool of claim 1, wherein an angle θ between a longitudinal axis of the tube and an edge of the butt of the firearm is between about 5° and about 60°.

11. The unloading tool of claim 1 wherein the length of the tube is about 6 inches.

12. The unloading tool of claim 1, further comprising a slot in the distal end of the tube for receiving a head of a screwdriver.

* * * * *